United States Patent [19]

Lamb, Sr.

[11] Patent Number: 4,506,886

[45] Date of Patent: Mar. 26, 1985

[54] BASKETBALL PRACTICE APPARATUS

[76] Inventor: Don Q. Lamb, Sr., 819 Humboldt St., Manhattan, Kans. 66502

[21] Appl. No.: 595,711

[22] Filed: Apr. 2, 1984

[51] Int. Cl.[3] ..... A63B 63/08

[52] U.S. Cl. ..... 273/1.5 A

[58] Field of Search ..... 273/1.5 A

[56] References Cited

U.S. PATENT DOCUMENTS

| | | | |
|---|---|---|---|
| 1,628,364 | 5/1927 | Hiett . | |
| 2,039,794 | 5/1936 | Hayden | 273/1.5 A |
| 2,085,206 | 6/1937 | Holmdahl | 273/1.5 |
| 2,593,758 | 4/1952 | Holmdahl | 273/1.5 |
| 2,634,067 | 12/1950 | Rubin | 273/1.5 |
| 2,964,316 | 12/1960 | Rose | 273/26 |
| 2,978,246 | 4/1961 | Groningen | 273/26 |
| 3,011,784 | 12/1961 | Segretto | 273/26 |
| 3,025,058 | 3/1962 | Brumfield | 273/1.5 |
| 3,698,712 | 10/1972 | Pero | 273/26 |
| 4,226,416 | 10/1980 | Callanan | 273/1.5 |
| 4,244,569 | 1/1981 | Wong | 273/1.5 |
| 4,352,494 | 10/1982 | Wells | 273/1.5 |

OTHER PUBLICATIONS

The Research Quarterly, vol. 22, No. 2, 5-1951, pp. 234-243.

*Primary Examiner*—Paul E. Shapiro

*Attorney, Agent, or Firm*—D. A. N. Chase; Michael Yakimo, Jr.

[57] ABSTRACT

A target practice apparatus for improving the shooting accuracy of a basketball player is releasably mounted to a basketball goal to present a target clearly above the rim and aligned along a vertical centerline of the horizontal plane containing the rim. The target also contains a point of a desired curvilinear path of a shot basketball between the player and goal. Upon proper contact by a shot basketball, the target swings to a position away from the desired path to allow passage of the basketball through the underlying goal. The displaced target is spring biased towards its centerline position so as to offer a proper and easily viewed aiming point awaiting the next shot of the player.

9 Claims, 4 Drawing Figures

BASKETBALL PRACTICE APPARATUS

BACKGROUND OF THE INVENTION

This invention relates to a target device, operable with a basketball goal, for improving the shooting accuracy of a basketball player.

Various training devices have been designed in an attempt to improve the shooting accuracy of a basketball player. Such devices include the attachment of a rigid arcuate member to the basketball rim which defines an upwardly extending semi-elliptical area above the rim and a target area for the shooter. Shooting the ball through this target area is said to improve the shooting accuracy of the player.

Another training device utilizes a target in the form of a brightly colored ball which extends to a position substantially immediately below the rim. The shooter attempts to hit the target with the basketball which is said to improve shooting accuracy.

Although assumably effective in their operation, I have found it advantageous to present a target above the rim which presents a clearly visible aiming point to the player. A target positioned below the rim or immediately adjacent thereto cannot be easily seen by the player as the rim and/or net obscure the same. Also, placement of the target below the rim allows the player to sink the ball through the goal without properly hitting the target device. Thus, no positive feedback flows to the shooter which diminishes the efficacy of the training apparatus.

In response thereto, I provide a basketball practice apparatus, particularly designed for free-throw shooting but not limited thereto, which releasably mounts a target above the rim and in alignment with the vertical centerline normally passing through the horizontal plane of the rim. The target, in the form of a brightly colored ball or the like, is positioned by a boom along the extent of the centerline so as to lie adjacent the end of a desired curvilinear path of a shot basketball between the shooter and the goal. This path corresponds to a preferred arch of the ball which increases the probability of the shot ball passing through the underlying goal. The target yields to ball contact only when the basketball approaches the target from antecedent points along this curvilinear path. This desired contact pivots the boom and target out of the desired path which allows the ball to pass through the underlying goal. Thus, positive feedback flows to the shooter only when the proper basketball/target contact is achieved. The boom is spring biased which returns the target to its initial aiming point mode awaiting the player's next shot. Proper, consistent usage of my target practice apparatus improves shooting accuracy and it is posited that after consistent usage an illusion of the target ball may appear to the shooter without the target practice apparatus in place. My preferred embodiment is particularly designed for use as a free-throw training device but need not be limited thereto.

It is therefore a general object of this invention to provide a basketball practice apparatus for improving shooting accuracy.

Another object of this invention is to provide a basketball practice apparatus, as aforesaid, which utilizes a target device above the rim of the basketball goal to present an unobscured aiming point to the shooter.

Still another object of this invention is to provide a basketball practice apparatus, as aforesaid, having the target aligned with and along the extent of the vertical centerline of the plane of the rim to present an aiming point along a desired curvilinear path of the ball between the shooter and the goal.

Another general object of this invention is to provide a basketball practice apparatus, as aforesaid, which impedes the passage of a ball through the goal if shot through a path other than a desired curvilinear path.

A more particular object of this invention is to provide a basketball practice apparatus, as aforesaid, wherein said target is yieldably responsive to a basketball properly traveling through said desired curvilinear path to allow passage of the ball through the goal.

Another particular object of this invention is to provide a target practice apparatus, as aforesaid, wherein the target is vertically adjustable so as to adjust the "arch" of the desired curvilinear path.

A further object of this invention is to provide a target practice apparatus, as aforesaid, which is releasably mounted to the basketball goal.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 2:
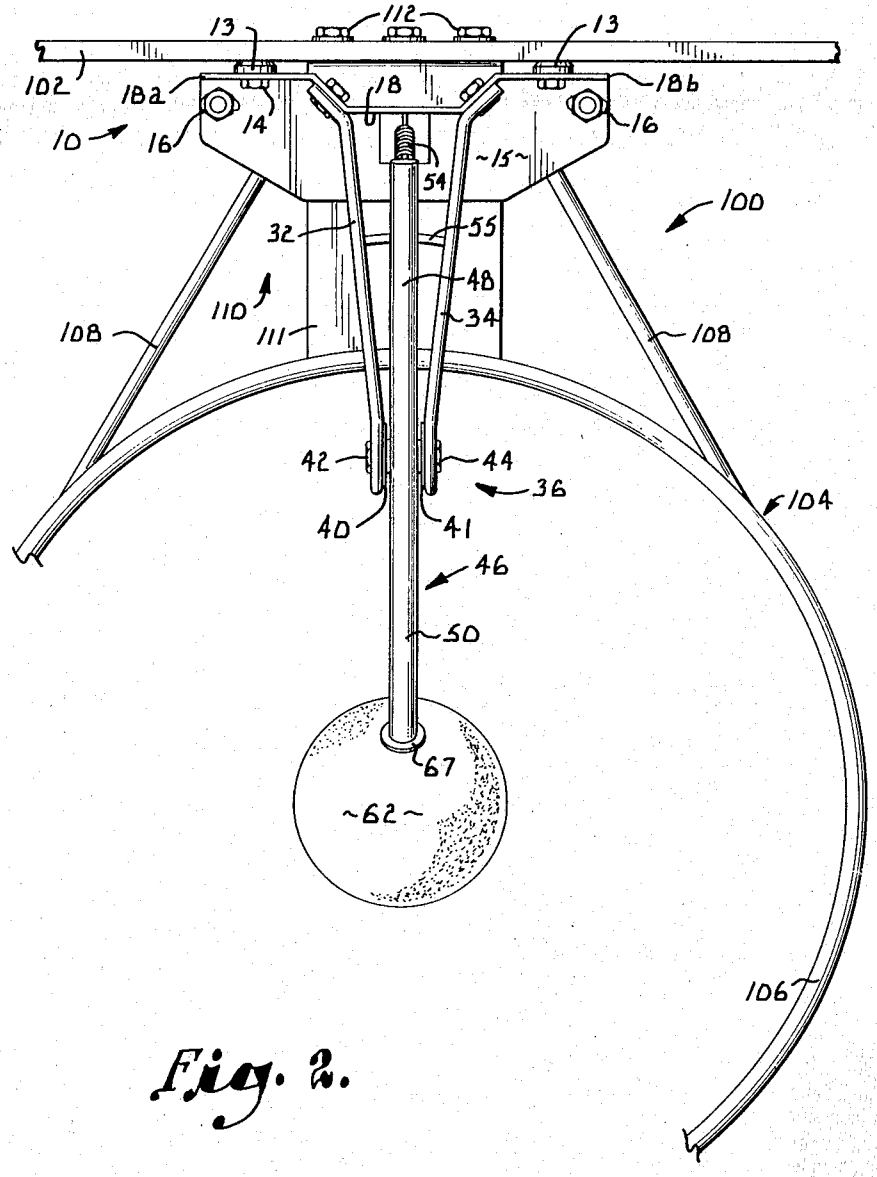
FIG. 2 is a top plan view of the device in FIG. 1, on an enlarged scale, with the rim broken away for purposes of illustration.
Figure 1:
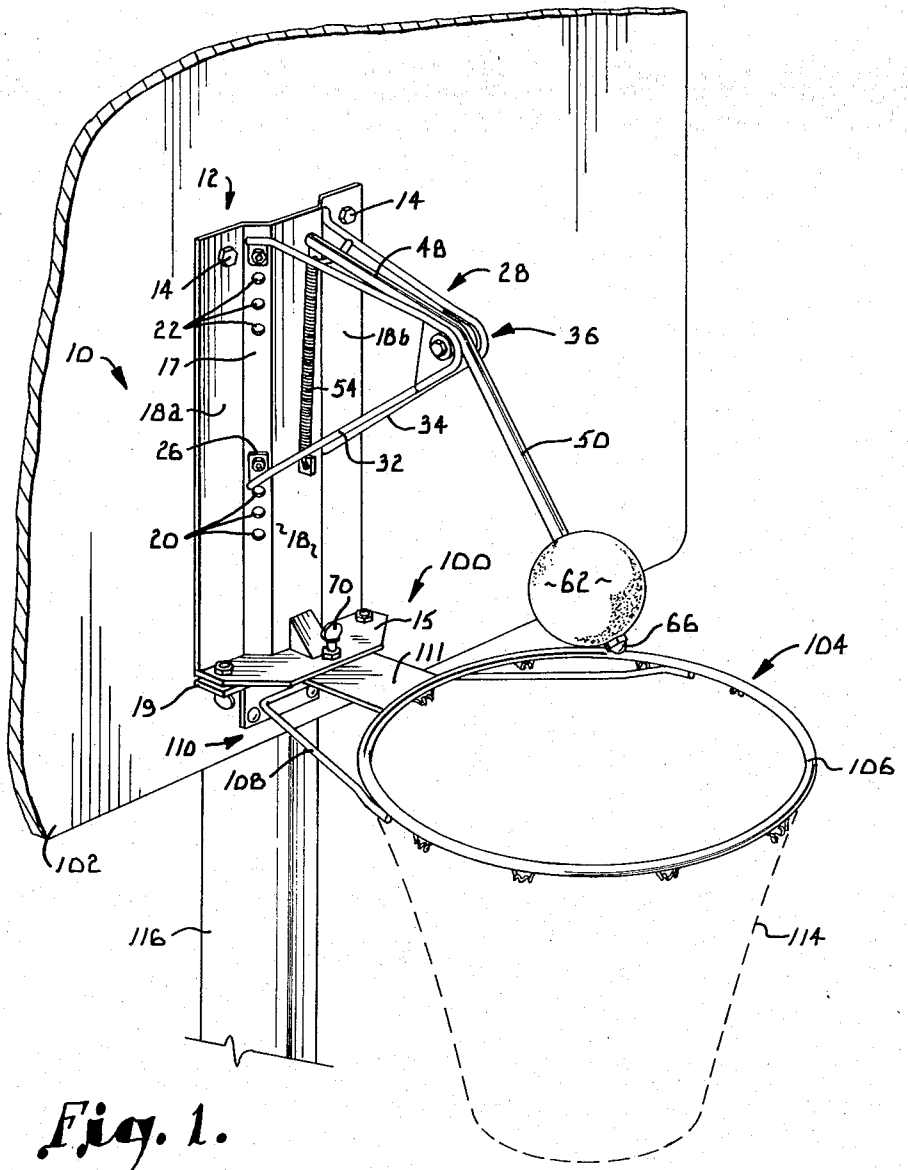
FIG. 1 illustrates the basketball practice apparatus affixed to a backboard and in a first mode of operation relative to the basketball goal therebelow.

Referring now particularly to the drawings, FIG. 1 illustrates the basketball practice apparatus 10 in combination with a conventional basketball goal assembly 100. The goal assembly 100 comprises a backboard 102 attached to an upstanding pole 116. (The backboard 102 and pole 116 are fragmentarily shown for purposes of illustration.) Attached to the backboard 102 is a basketball goal 104 in a generally normal relationship with the backboard 102.

The basketball goal 104 comprises a rim 106 and mounting bracket 110 including reinforcing struts 108 and flange 111. The bracket 110 is affixed to the backboard 102 by bolt/nut combinations 112 in a conventional manner. In FIG. 1 a phantom outline 114 of a basketball net 114 is shown.

The basketball practice apparatus 10 generally comprises a mounting plate 12 having a base section 15 and face section 18. The plate 12 is positioned adjacent the backboard 102 by clamping the base 15 to the rim supporting flange 111 of the mounting bracket 110. Resilient spacers 13 surrounding bolts 14 prevent the mounting plate 12 from marring the backboard 102 during use.

This clamping is achieved by connecting the clamping plate 19 to the base 15 by means of wingbolt/nut combinations 16 so that the supporting flange 111 of bracket 110 is interposed therebetween. Another wingbolt 70 extends through the center of the base 15 and bears against the topside of the rim supporting flange 111 of bracket 110. Accordingly, opposing forces are presented on the flange 111 to hold the apparatus 10 in place.

Positioned along side walls 18*a*, 18*b* of mounting plate 12, which extend between the mounting flanges 17, 17' and protruding face 18, are a series of vertically aligned apertures 20, 22. These apertures 20, 22 are aligned with an aperture in upper and lower mounting tabs 24, 26 attached to the free ends of struts 32, 34 of a target support bracket 28. Upon alignment, bolt/nut combinations 30 secure the strut ends of the target support bracket 28 to the mounting plate 12.

The target support bracket 28 comprises first 32 and second 34 laterally spaced-apart struts supporting a pivot assembly 36 at one end thereof. The pivot assembly 36 comprises flanges 38 spanning the forward end of the struts 32, 34, adjacent washers 40, 41 and a horizontally disposed bolt 42 passing through the flanges 38 and secured thereto by nut 44.

A tubular boom 46, comprising first 48 and second 50 tubular arms, has a free end 52 attached to a spring 54 by means of flange 56. The opposed end of spring 54 is attached to a flange 58 protruding from the face 18.

The juncture of the first 48 and second 50 arms of boom 46 lies superiorly adjacent to the imaginary horizontal axis presented by bolt 42 so that bolt 42 defines an axis of pivot for the boom 46. The second arm 50 is biased by spring 54 so that the longitudinal axis of arm 50 intersects the vertical centerline of the plane of the rim 106 at a selectable point therealong. An arcuate cradle 55 extends between the struts 32, 34 so as to delimit the biased movement of the boom arm 48 and thus hold the arm 50 at a proper position. A brightly colored target ball 62 is positioned along the free end of the arm 50 by extension of the arm 50 through the ball 62. Bolt 66 is inserted into the open end of the tubular arm 50 to attach the target ball 62 in place with washers 67 delimiting movement of the ball along the arm 50. The center of the attached ball 62 is preferably coincident with the point of intersection of the vertical centerline of the rim 106 and longitudinal axis of the tubular arm 50.

The target ball 62 may be selectably shifted along the longitudinal extent of the vertical centerline by alignment of the mounting tabs 24, 26 of the target support bracket 28 with the selected lower 20 and upper 22 apertures along the side walls 18*a*, 18*b*. This target ball 62 defines a point of a curvilinear path corresponding to a preferred path of a shot basketball extending between the shooter and the underlying goal 104. Selectable shifting of the target ball 62 adjusts the curvilinear path and "arch" thereof according to the desires of the user. Thus the target ball 62 presents an easily discernible aiming point in a desired curvilinear path.

Figure 3:
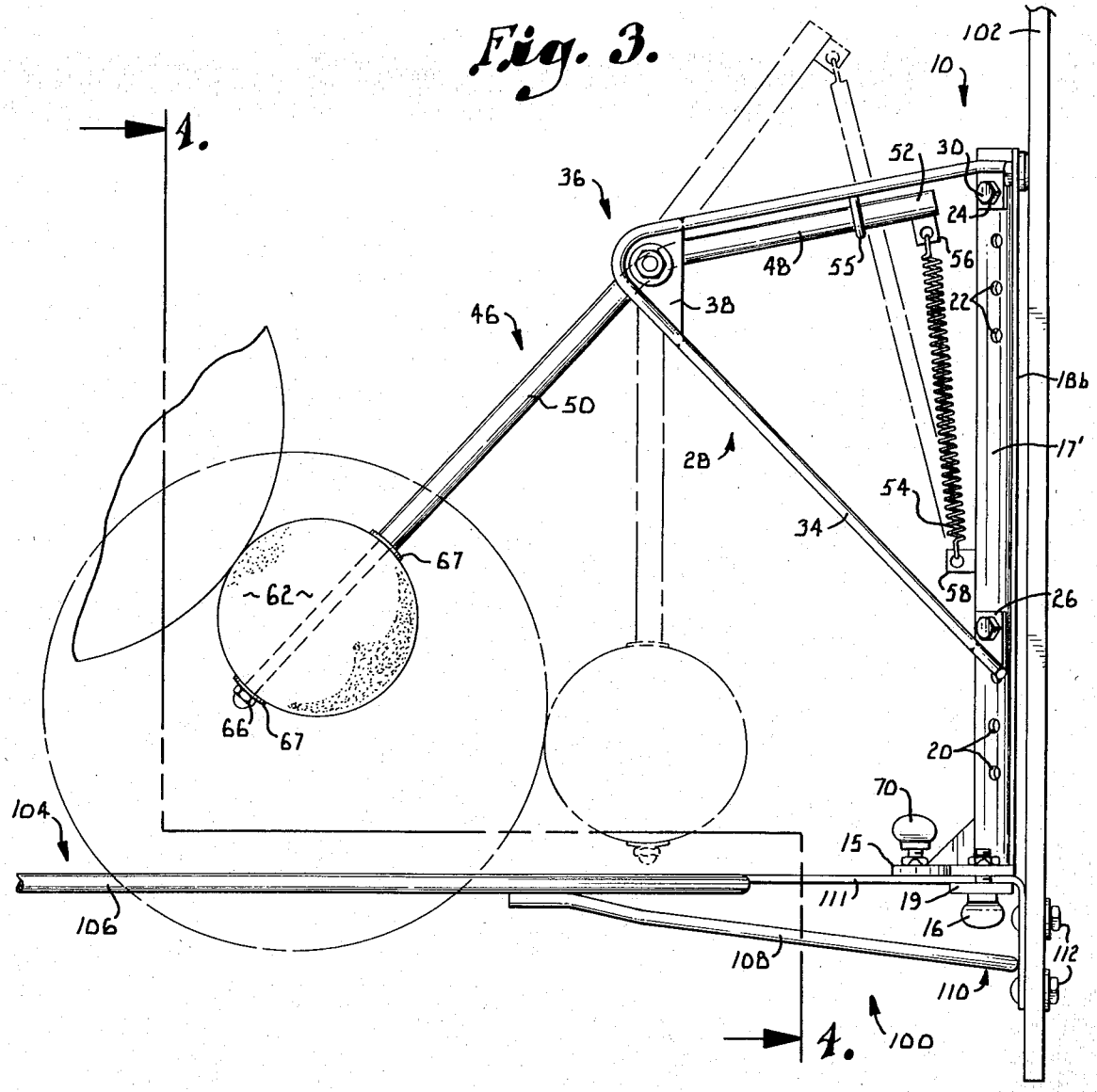
FIG. 3 is a side elevation view of the apparatus in FIG. 1, on an enlarged scale, and showing in solid lines the apparatus in a first mode of operation with the target thereof being struck by a basketball, as fragmentarily shown, and showing in phantom lines the apparatus in a second mode of operation allowing passage of the basketball through the goal.
Figure 4:
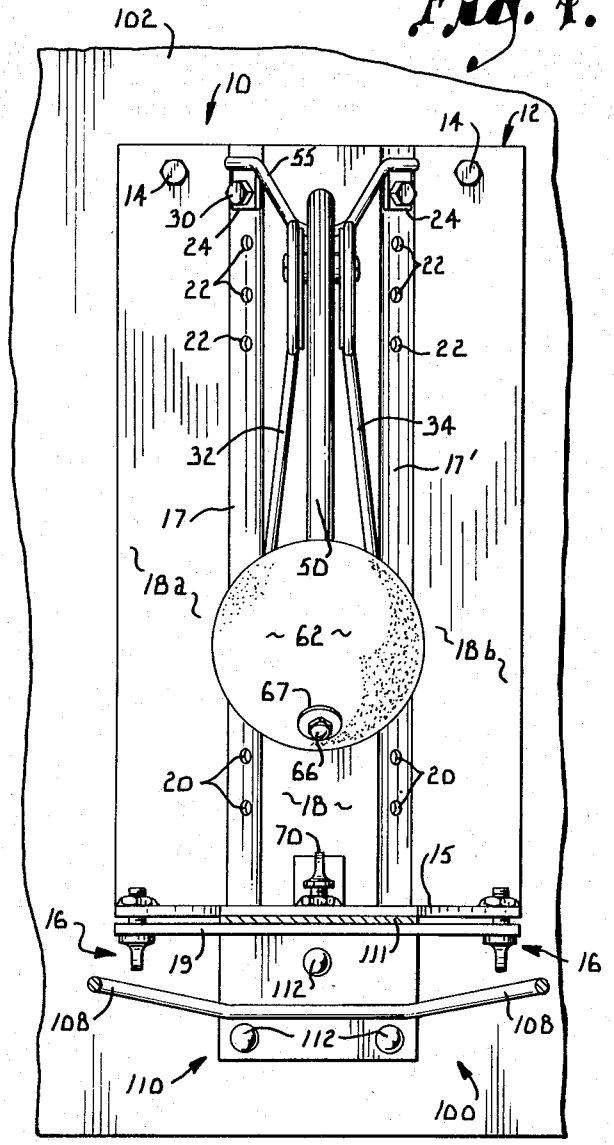
FIG. 4 is a front elevation of the target practice apparatus taken along line 4—4 in FIG. 3.

As diagrammatically shown in FIG. 3, proper contact of the basketball with the target 62 overcomes the spring 54 bias so as to pivot the arms 48, 50 about the horizontal axis, defined by bolt 42, and attached target ball 62 to the phantom line position. This pivotal action precludes interference of the target 62 with the basketball as it travels through its preferred curvilinear path and into the underlying goal 104. The boom 46 being spring biased will then pivotally swing to its solid line position as shown in FIG. 3.

The relationship of the basketball with the target ball 62 is a critical one in order to achieve pivotal movement of the boom 46 and attached target ball 62 from its aiming point mode to a second mode precluding interference of the target 62 with the basketball. If the shooter does not direct the basketball through the proper antecedent points of the preferred curvilinear path, the preferred basketball/target ball 62 contact will not be achieved and boom 46 will not pivot the target ball 62 to its noninterfering mode as shown by phantom lines in FIG. 3. Thus, the target ball 62 interferes with passage of the basketball through the underlying goal. Accordingly, positive feedback is provided to the shooter which forces the shooter to shoot the basketball through the proper curvilinear path and develop a proper "arch" so as to increase his shooting accuracy. Shifting of the target ball 62 along the vertical centerline of the rim 106, as above described, will alter the desired curvilinear path. This will change the preferred "arch" of the basketball, as shot by the player, in order to attain the proper basketball/target ball 62 relationship.

Although my preferred embodiment is utilized for free-throw shooting, the apparatus may be used by the shooter from other areas of the court as long as a proper relationship between the basketball and target ball 62 is achieved which will swing the target ball 62 to its noninterfering mode as shown by the phantom line position in FIG. 3. If so used, the target support bracket 28 and boom 46 should be structurally reinforced. Also, the preferred basketball/target ball 62 relationship must be adjusted from that shown in FIG. 3 in order to pivot the boom 46 and target ball 62 to its displaced (phantom line) mode. Accordingly, my target practice apparatus is adaptable for uses other than the improvement of free-throw shooting.

It is to be understood that while a certain form of this invention has been illustrated and described, it is not limited thereto, except in so far as such limitations are included in the following claims.

Having thus described the invention, what is claimed as new and desired to be secured by Letters Patent is:

1. In combination with a basketball goal assembly including a rim, a backboard, means for affixing said rim to said backboard in a normal relationship therebetween, a device for improving a player's accuracy in shooting a basketball into said goal comprising:

a target;

means for mounting said target above said rim in pivotal movement between two modes of operation with said first mode relatively aligning said target with a vertical centerline normally extending through the plane of said rim and a second mode displacing said target away from said centerline, said target mounting means comprises:

a bracket member having first and second ends;

a pivot assembly at said second end of said bracket member and presenting a horizontal axis therein;

a boom having first and second ends;

means for releasably mounting said bracket member to said backboard with said pivot assembly generally extending above said plane of said rim;

means for mounting said boom member in swingable movement about said horizontal axis of said pivot assembly; and means for fastening said target to said second end of said boom;

bias means for urging said second end of said boom towards said centerline for an intersection therewith and said target into said first mode so that said target is positioned in a desired curvilinear path of a shot basketball between said shooter and said goal, said basketball traveling through said path contacting said target in a relationship which overcomes said bias and urges said target into said second mode to allow passage of said shot basketball through said underlying goal whereby said target urges said shooter to direct said basketball along said path.

2. The apparatus as claimed in claim 1 wherein said bracket mounting means comprises:

a mounting plate having a face section and a base section generally normal to said face section;

means for fastening said first end of said bracket to said face;

a clamping plate;

means for connecting said clamping plate to said base with a horizontal supporting flange extending between said rim and said backboard interposed therebetween, whereupon said face lies generally adjacent said backboard with said bracket extending away from said backboard and above said rim.

3. The apparatus as claimed in claim 2 wherein said connecting means comprises:

at least one fastener element extending through said clamping plate and base; and a bolt member extending through said base and bearing upon said rim supporting flange to preclude movement of said base and said clamping plate relative to said supporting flange during use.

4. The apparatus as claimed in claim 2 further comprising spacers interposed between said backboard and said mounting plate to preclude marring of said backboard during apparatus use.

5. The apparatus as claimed in claim 2 wherein said boom mounting means comprises a spring extending between said mounting plate and said boom, said spring further presenting said bias means with normal extension of said spring urging said boom member into said swingable movement about said horizontal axis to position said second end of said boom towards said vertical centerline.

6. The apparatus as claimed in claim 2 further comprising means for shifting said target along said centerline and comprising:

at least one mounting flange presenting said fastening means at said first end of said bracket and including an aperture therein;

a plurality of apertures vertically disposed along the extent of said face of said mounting plate and generally parallel to said vertical centerline; and means for releasably aligning the aperture of said at least one mounting flange with a selected aperture of said plurality of apertures along said face of said mounting plate, said releasable alignment vertically shifting said bracket relative to said rim plane whereby to shift the intersection of said boom along said centerline and said target attached thereto.

7. The apparatus as claimed in claim 1 wherein said pivot assembly includes a horizontally disposed bolt member associated with the second end of said bracket member, said bolt underlying said boom to present a horizontal axis of pivot thereof.

8. The apparatus as claimed in claim 1 wherein said bias means comprises a spring member connected to said target with said spring urging said target into said first mode of operation upon a normal extension thereof.

9. The apparatus as claimed in claim 1 wherein said target comprises a sphere with the center of said sphere lying along the extent of said vertical centerline.

* * * * *